US006219989B1

(12) United States Patent
Tumura

(10) Patent No.: US 6,219,989 B1
(45) Date of Patent: Apr. 24, 2001

(54) CONSTRUCTION METHOD OF JOINING COLUMN AND BEAM IN BUILDING STRUCTURE BASED ON HEAVY-WEIGHT STEEL FRAME CONSTRUCTION

(76) Inventor: Shinichi Tumura, Arukasuteru H-1, 1-8, Funabashi 3-chome, Setagaya-ku Tokyo (JP)

( * ) Notice: Subject to any disclaimer, the term of this patent is extended or adjusted under 35 U.S.C. 154(b) by 0 days.

(21) Appl. No.: 09/449,982

(22) Filed: Nov. 26, 1999

(51) Int. Cl.[7] ..... E04C 3/30

(52) U.S. Cl. ..... 52/726.3; 52/741.1; 52/745.21; 52/295; 52/726.1; 52/726.2; 52/274

(58) Field of Search ..... 52/741.1, 745.21, 52/295, 296, 299, 726.1, 726.2, 726.3, 264, 274, 729.1, 732.1, 732.2, 732.3

*Primary Examiner*—Carl D. Friedman
*Assistant Examiner*—Patrick J. Chavez

(74) *Attorney, Agent, or Firm*—Browdy and Neimark

(57) ABSTRACT

A beam is joined to a column by the steps of setting upright a square sleeve formed by a steel material in the shape of a box and/or square cylinder to the center of the upper surface of a base plate formed by a steel material in the shape of a plate in a posture of extending an axis in a vertical direction to connect the square sleeve to the base plate by welding, placing the base plate to the upper surface of a constructed footing through anchor bolts, inserting the lower end of a square column pipe formed by a steel material in the shape of square pipe into the square sleeve on the upper surface side of the base plate, tying the square column pipe with the connecting bolts inserted into bolt holes provided in the square column pipe and also bolt holes provided at predetermined positions of the wall surface of the square sleeve, then bringing an end plate formed by a steel material into contact with the wall surface of the square sleeve by making it condition that the end plate is preliminarily welded as one body to the longitudinal end surface of the beam, and fastening the end plate to the square sleeve with the connecting bolts.

4 Claims, 11 Drawing Sheets

CONSTRUCTION METHOD OF JOINING COLUMN AND BEAM IN BUILDING STRUCTURE BASED ON HEAVY-WEIGHT STEEL FRAME CONSTRUCTION

BACKGROUND OF THE INVENTION

1. Field of the Invention

This invention relates to the improvement on a construction method of joining a column and a beam both serving as main parts of steel frame structural material in the case of constructing a building structure on the basis of heavy-weight steel frame construction.

2. Description of the Prior Art

A so-called diaphragm construction method of joining a column and a beam by the steps of setting up each column on a footing by making it condition that an auxiliary joint member formed by a steel plate to join the end of a beam thereto is preliminarily mounted to the column by welding, and then placing the beam over between the auxiliary joint members to join the columns and the beam at their laps with connecting bolts is known as a construction method of joining a column and a beam both serving as main parts of steel frame structural material in the case of constructing a building structure on the basis of heavy-weight steel frame construction.

Since the conventional construction method (the diaphragm construction method) of joining the column and the beam as described above requires the column mounted with the auxiliary joint member, the column delivered after being assembled in a factory needs to be mounted with the auxiliary joint member before the delivery. Thus, the deformation or damage easily occurs to the auxiliary joint member mounted to the column in the course of transportation of the columns. Further, the auxiliary joint member mounted to the column makes it hard to load a truck with the columns in an orderly manner, resulting in troublesome loading.

Further, since each beam placed over between the columns takes the form having a joint portion as an inevitable consequence, a straight beam cannot be in use.

SUMMARY OF THE INVENTION

The present invention is provided to settle the above problems encountered with the conventional means, and its object is to provide a new means which enables to easily perform the loading of columns for transportation in an orderly manner by eliminating the need for an auxiliary joint member having been heretofore mounted to each column before the delivery and also to use a straight material with no joint portion for a beam by making it possible to join the beam to the column by means of connection with bolts.

In the present invention, there is provided a construction method of joining a column and a beam in a building structure based on heavy-weight steel frame construction for attaining the above object, and this construction method comprises the steps of setting upright a square sleeve formed by a steel material in the shape of a box and/or square cylinder on the center of the upper surface of a base plate formed by a steel material in the shape of a plate in a posture of extending an axis in a vertical direction to integrally connect the square sleeve to the center of the upper surface of the base plate by welding, placing the base plate to the upper surface of a constructed footing through anchor bolts, inserting the lower end side of a square column pipe formed by a steel material in the shape of a square pipe into the square sleeve on the upper surface side of the base plate, tying the square column pipe and the square sleeve in a temporary tightening state with connecting bolts inserted into bolt holes provided in the square column pipe and also bolt holes provided at predetermined positions of the wall surface of the square sleeve, bringing an end plate formed by a steel material into contact with the wall surface of the square sleeve by making it condition that the end plate is preliminarily welded to the longitudinal end surface of a beam as one body, and fastening the end plate to the square sleeve with the connecting bolts to join the beam to the column.

In the construction method of joining the column and the beam both serving as main parts of steel frame structural material in the case of constructing the building structure on the basis of heavy-weight steel frame construction according to the present invention, a column base part needs the following structural members for the execution of this construction method, that is, the base plate formed by the steel material in the shape of the plate and placed to the upper surface of the constructed footing with anchor bolts, the square sleeve formed by the steel material in the shape of the box and/or square cylinder and set upright on the upper surface of the base plate in the manner of integrally connecting the square sleeve to the base plate by welding, the square column pipe formed as a column by the steel material in the shape of the square pipe smaller in diameter than the square sleeve, and the end plate formed by the steel material and preliminarily welded to the longitudinal end of the beam as one body in a posture of being accurately orthogonal to the longitudinal direction of the beam. The base plate with the square sleeve welded to its upper surface is mounted to the upper surface of the constructed footing and is then placed in position thereto with the anchor bolts, and the square column pipe serving as the column is inserted Into the square sleeve in the dropping manner.

In the square sleeve, bolt holes as many as the positions calculated on the basis of a structural calculation are preliminarily provided at the calculated positions of the wall surface to permit the insertion of the connecting bolts for connecting the end plate preliminarily welded as one body to the end of the beam to a predetermined position of the wall surface of the square sleeve, and the connecting bolts are inserted into these bolt holes in the temporary tightening state.

Then, the column and the beam in the column base part are joined by the steps of bringing the end plate preliminarily welded to the end of the beam into contact with the predetermined wall surface out of four wall surfaces of the square sleeve, into which the lower end of the square column pipe is preliminarily inserted in the dropping manner, and then inserting the temporarily-tightened connecting bolts into the bolt holes provided in the end plate at positions corresponding to the bolt holes provided in the wall surface of the square sleeve to tighten the connecting bolts with the nuts.

In a column middle part, the square sleeve, the square column pipe and the end plate preliminarily welded to the longitudinal end of the beam are used for the structural members. In this case, the square sleeve is used as an independent member without the need for the base plate.

After the process of fitting the square sleeve around the circumference of a joint portion between the upper end of the square column pipe for a lower floor and the lower end of the square column pipe for an upper floor to temporarily tighten the square sleeve to the upper and lower square column pipes with the connecting bolts, the column and the beam in the column middle part are joined by the steps of bringing the end plate preliminarily welded to the beam serving as a ceiling beam or an upper beam into contact with the outer wall surface of the square sleeve, and then inserting the temporarily-tightened connecting bolts into the bolt holes provided in the end plate to tighten the connecting bolts with the nuts.

In the construction method of joining the column and the beam, particularly in the construction method of joining the column and the beam in the column base part, a base isolation pad is sometimes interposed between the base plate and the upper surface of the footing in the case of placing the base plate with the square sleeve welded as one body thereto to the upper surface of the constructed footing to fasten the base plate to the footing with the anchor bolts.

Further, it is effective to insert the lower end of the square column pipe into the square sleeve set upright on the upper surface of the base plate fastened to the upper surface of the footing directly or through the base isolation pad by making it condition that the connecting bolts are preliminarily inserted in the temporary tightening state into the bolt holes provided in predetermined portions of the square sleeve, while the square column pipe is provided with notches in the shape of vertically elongate grooves in lower end portions corresponding to the temporarily-tightened connecting bolts to allow the square column pipe to be inserted into the square sleeve so as to fit the notches to the connecting bolts.

Then, after the process of bringing the end plate of the beam into contact with the outer surface of the square sleeve of the column base part constructed in this manner to fasten the end plate to the square sleeve with the temporarily-tightened connecting bolts, injection of non-shrink mortar is performed through a mortar injection port provided in an appropriate portion of the square column pipe into the cavity of the square sleeve and also the lower end cavity of the square column pipe to unite the square sleeve and the square column pipe together. The fastening with the nuts of the connecting bolts may be performed after two or three days for the hardening of non-shrink mortar.

The injection of non-shrink mortar is also available for the construction method of joining the column and the beam in the column middle part. In this case, before the process of fitting the lower half of the square sleeve around the upper end circumference of the square column pipe for the lower floor, a mortar receiver needs to be formed by injecting instantaneous foaming urethane foam to the upper surface of a urethane foam receiver such as a wire net provided in the shape of a shelf in the cavity of the square column pipe to be located at the bottom of a portion lapped with the square sleeve.

After the process of inserting the lower end of the square column pipe for the upper floor into the upper half of the square sleeve by using notches formed in the lower edge of the square column pipe for the upper floor in correspondence to the connecting bolts similarly to the case of the column base part described above in a state that the connecting bolts are preliminarily inserted in the temporary tightening state into also the upper half of the square sleeve temporarily tightened with the connecting bolts, connecting the lower end of the square column pipe for the upper floor to the connecting bolts preliminarily inserted in the temporary tightening state into the square sleeve and also to the upper end of the square column pipe for the lower floor, and then, in this state, bringing the end plate preliminarily welded to the end of the beam into contact with the predetermined outer wall surface of the square sleeve to fasten the end plate to the square sleeve with the connecting bolts, the injection of the non-shrink mortar is performed through a mortar injection port provided in an appropriate portion of the square column pipe in a state that the end plate is fastened to the square sleeve with the connection bolts.

Also, in this case, the fastening with the connecting bolts may be performed after the hardening of mortar.

BRIEF DESCRIPTION OF THE DRAWINGS

The foregoing and other objects and features of the invention will become apparent from the following description of preferred embodiments of the invention with reference to the accompanying drawings, in which.

DESCRIPTION OF THE PREFERRED EMBODIMENTS

Figure 1:
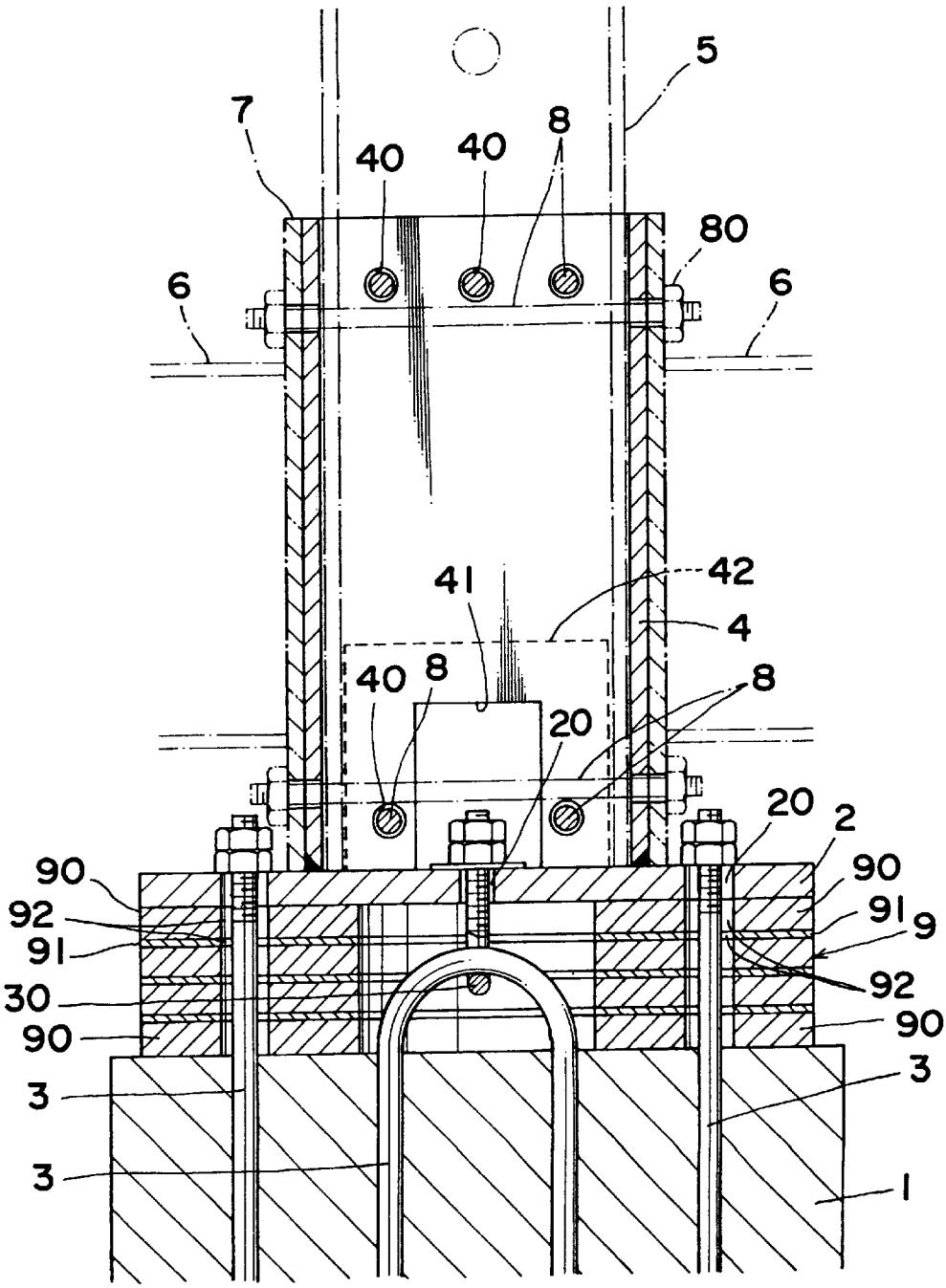
FIG. 1 is a longitudinal sectional front view showing a column base part under construction in an embodiment of a construction method of joining a column and a beam according to the present invention.

FIG. 1 is a longitudinal sectional view showing a column base part under construction on the basis of a construction method of joining a column and a beam according to the present invention. In FIG. 1, reference numeral 1 denotes a constructed footing, 2 is a base plate formed by a steel material in the shape of a plate and fastened to the upper surface of the footing 1 with anchor bolts 3, 4 is a square sleeve formed by a steel material in the shape of a box and/or square cylinder and welded as one body to the center of the upper surface of the base plate 2 in an upright posture, 5 shown by a chain line is a square column pipe formed by a steel material in the shape of a square cylinder and/or square pipe smaller in diameter than the square sleeve 4 and inserted at its lower end into the square sleeve 4, 6 similarly shown by a chain line is a beam formed by a steel material into shape steel of H, I or like shape in section, 7 is an end plate formed by a steel material in the shape of a plate of a size corresponding to one wall surface out of four wall surfaces of the square sleeve 4 and preliminarily welded as one body to the longitudinal end of the beam 6 in a posture of being orthogonal to the longitudinal direction of the beam, 8 is a connecting bolt for integrally fastening the end plate 7 to the square sleeve 4, and 9 is a base isolation pad interposed between the footing 1 and the base plate 2.

The footing 1 includes a normal footing properly constructed as a continuous footing or an independent footing by means of placing the concrete.

Figure 3:
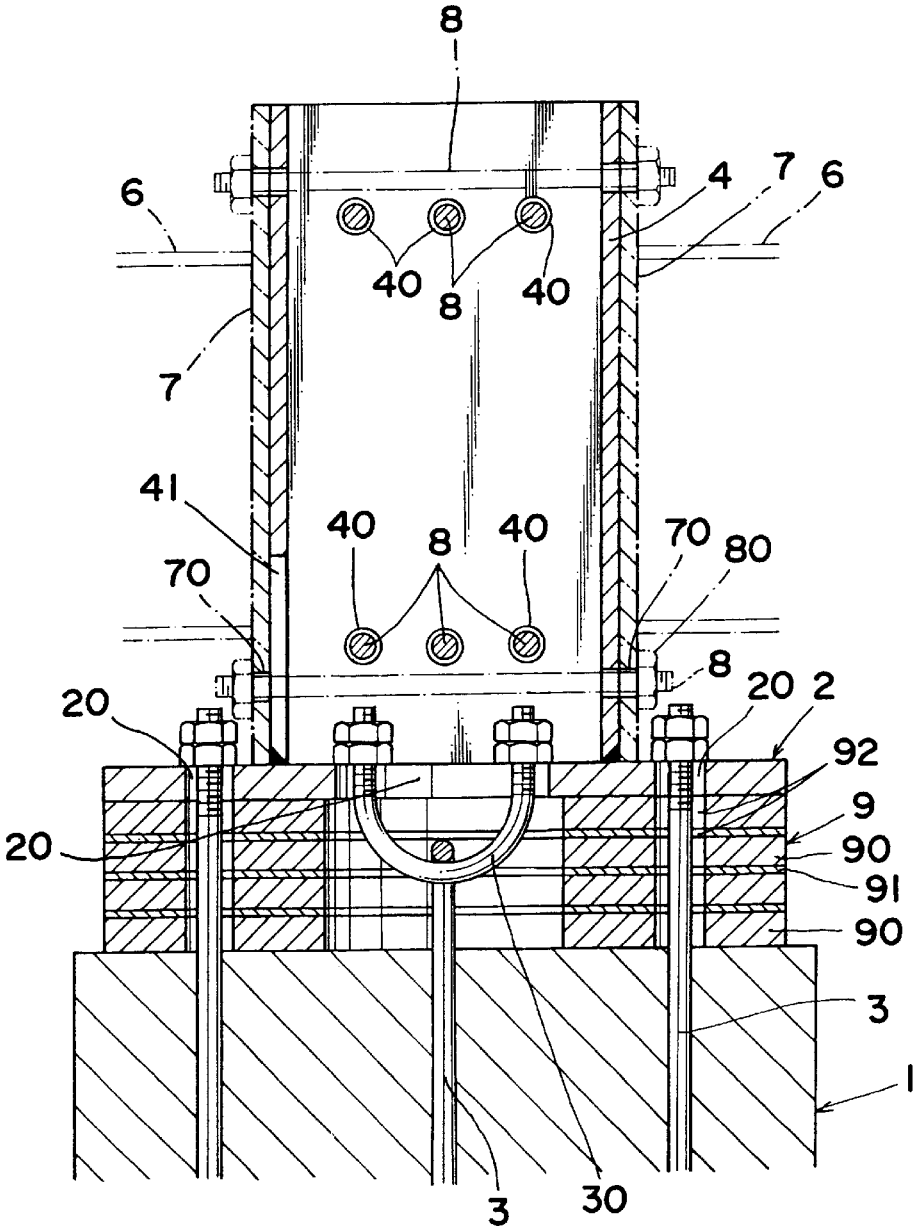
FIG. 3 is a longitudinal sectional side view showing the state of a base plate placed to the upper surface of a footing in the embodiment of FIG. 1.

The base plate 2 is formed by a thick steel plate in the shape of a square plate of a size somewhat smaller than the upper surface of the constructed footing 1 and has a proper number of bolt holes 20 at proper positions of the peripheral edge and the center to permit the insertion of the anchor bolts 3 planed into the footing 1. Among the bolt holes 20, the bolt hole 20 in the center is formed in the shape of a slot, since a U-shaped connecting bolt 30 needs to be combined with the anchor bolt 3 in use, as shown in FIG. 3.

Figure 2:
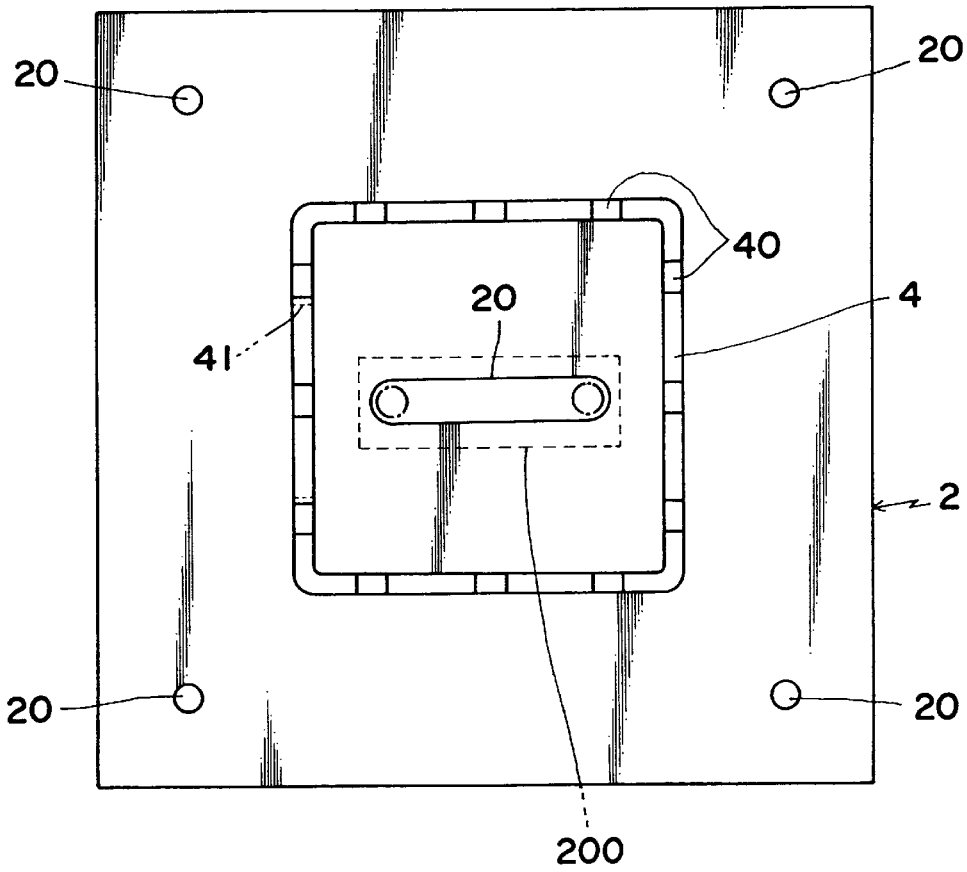
FIG. 2 is a plan view showing a base plate in the embodiment of FIG. 1.

The square sleeve 4 is formed by a thick steel plate in the shape of a box and/or square cylinder having a sectional area smaller in diameter than the base plate 2 and is disposed at the center of the base plate 2 as shown in FIG. 2. In addition, the lower edge of the square sleeve is formed in the shape of an inward taper surface 4*a* as shown in FIG. 4 to integrally connect the square sleeve in an upright posture to the upper surface of the base plate 2 as shown in FIG. 1 in the manner of electrically welding the bottom side of the taper surface 4*a* to the upper surface of the base plate 2.

Figure 4:
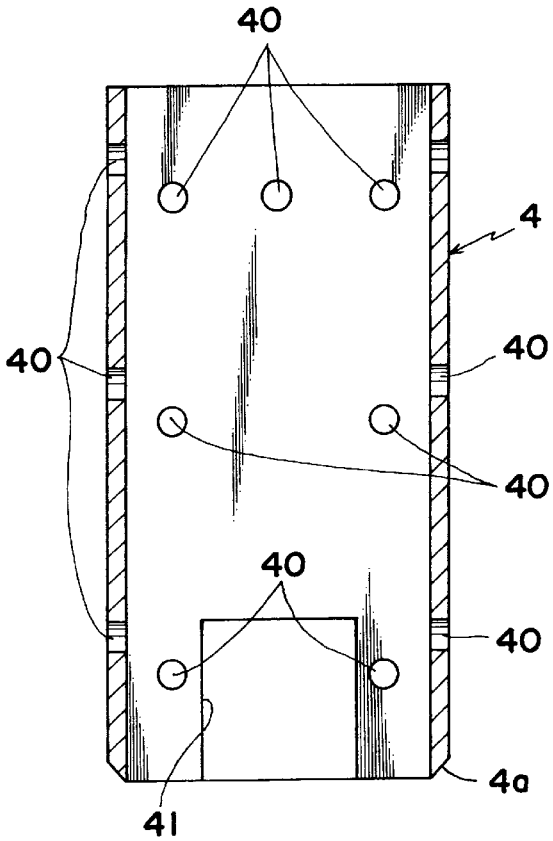
FIG. 4 is a longitudinal sectional front view showing a square sleeve before being welded to the base plate in the embodiment of FIG. 1.
Figure 5:
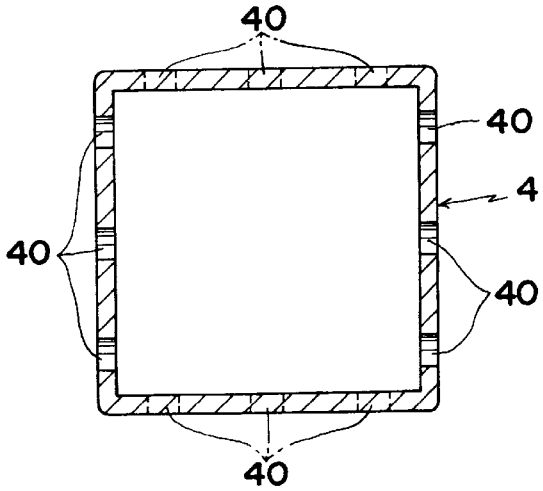
FIG. 5 is a cross-sectional plan view showing the square sleeve of FIG. 4.

The square sleeve 4 has bolt holes 40 in four wall surfaces to permit the insertion of the connecting bolts 8 as shown in FIGS. 4 and 5.

While these bolt holes 40 are provided to permit the connecting bolts 8 to pass through a space between a pair of confronting wall surfaces of the square sleeve 4, the positions of the bolt holes for the connecting bolts 8 passing through in a longitudinal direction and the positions of the bolt holes for the connecting bolts 8 passing through in a lateral direction need to be phase-shifted in a vertical direction so as to prevent the interference of these connecting bolts.

Further, an opening 41 for the operation of fastening the U-shaped connecting bolt 30 is provided in the lower end of one wall surface of the square sleeve 4. A cover plate 42 is mounted to the opening 41 to prevent the overflow of non-shrink mortar from occurring at the time of injecting this mortar.

Figure 6:
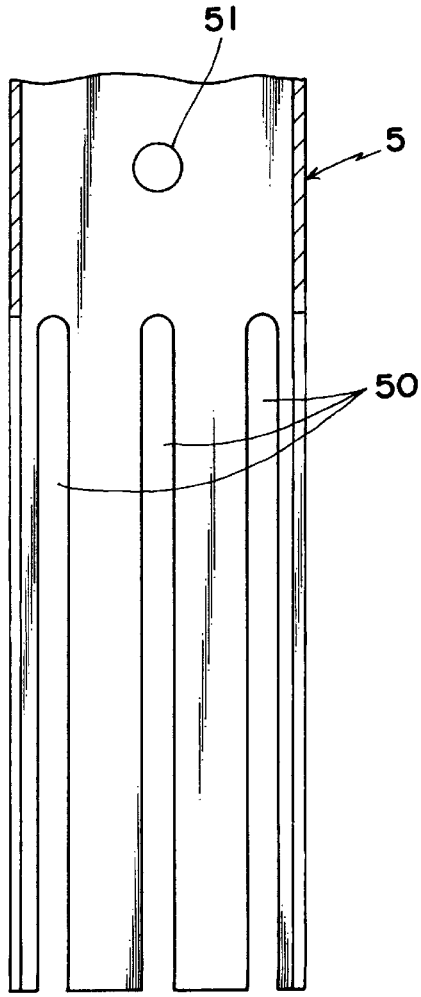
FIG. 6 is a longitudinal sectional view showing the lower end side of a square column pipe in the embodiment of FIG. 1.
Figure 7:
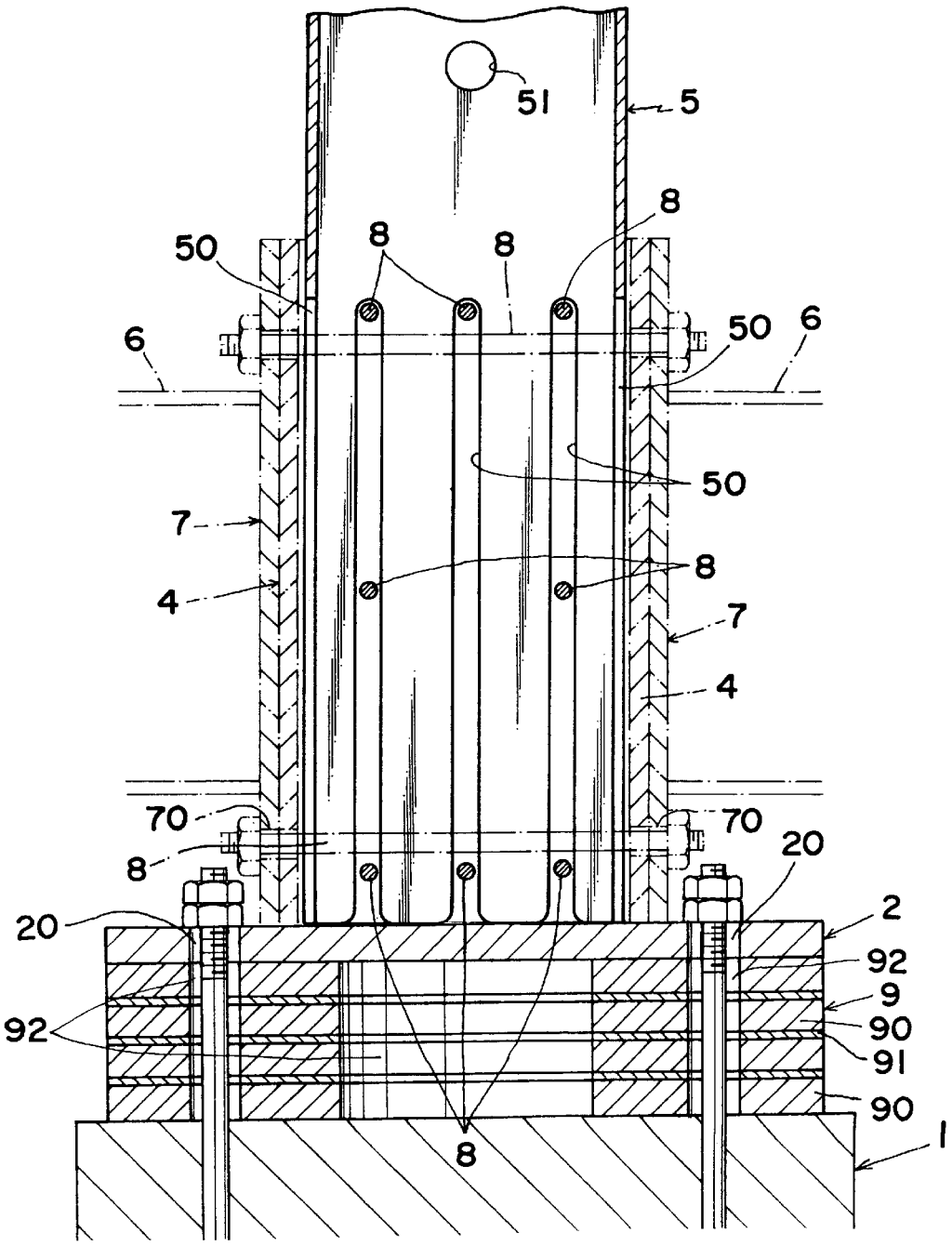
FIG. 7 is a view for explaining the state of connection between the square column pipe of FIG. 6 and the square sleeve with connecting bolts.

The square column pipe 5 is formed by a steel plate in the shape of a square pipe somewhat smaller in diameter than the square sleeve 4 to permit the insertion of the square column pipe into the square sleeve 4, and on its lower end side adapted to be inserted into the square sleeve 4, bolt holes to permit the insertion of the connecting bolts 8 are provided in portions aligned with the bolt holes 40 of the square sleeve 4 at a time when the square column pipe is inserted into the square sleeve 4. The bolt holes in the square column pipe are formed in the shape of vertically slit-like notches 50 as shown in FIG. 6. These notches 50 are provided in portions corresponding to the connecting bolts 8 preliminarily inserted in the temporary tightening state into the bolt holes 40 of the square sleeve 4 as shown in FIG. 7. The insertion of the lower end of the square column pipe 5 into the square sleeve 4 is performed so as to fit the notches 50 respectively into the connecting bolts 8 preliminarily inserted in the temporary tightening state into the square sleeve 4, resulting in the facilitation of insertion of the connecting bolts 8 for fastening.

Further, the square column pipe 5 has a non-shrink mortar injection port 51 in a portion slightly above the lower end adapted to be inserted into the square sleeve 4.

Figure 8:
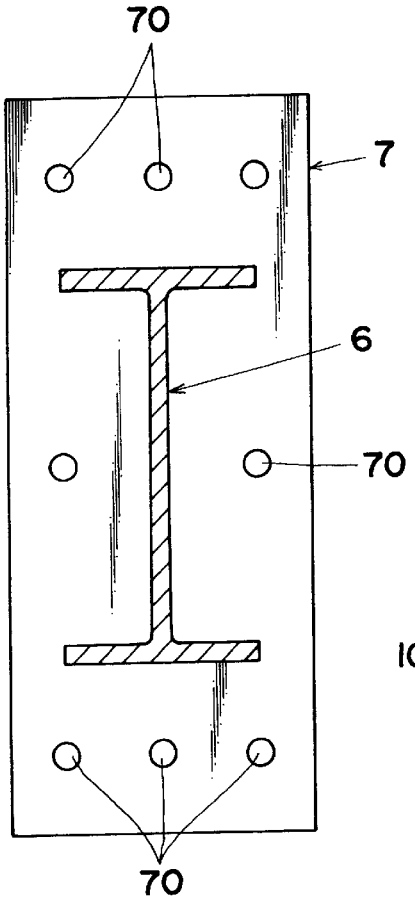
FIG. 8 is a longitudinal sectional view showing a beam in the embodiment of FIG. 1.

The beam 6 uses shape steel such as H-shape and I-shape steel formed by a steel material in the H, I or like proper sectional shape, and the end plate 7 formed by a steel plate in the shape of a square plate in conformity to one wall surface of the square sleeve 4 is integrally connected by electric welding to the longitudinal end of the beam in a posture of being accurately orthogonal to the longitudinal direction of the beam 6 and has bolt holes 70 in portions corresponding to the bolt holes 40 provided in the wall surface of the square sleeve 4, as shown in FIG. 8.

Figure 9:
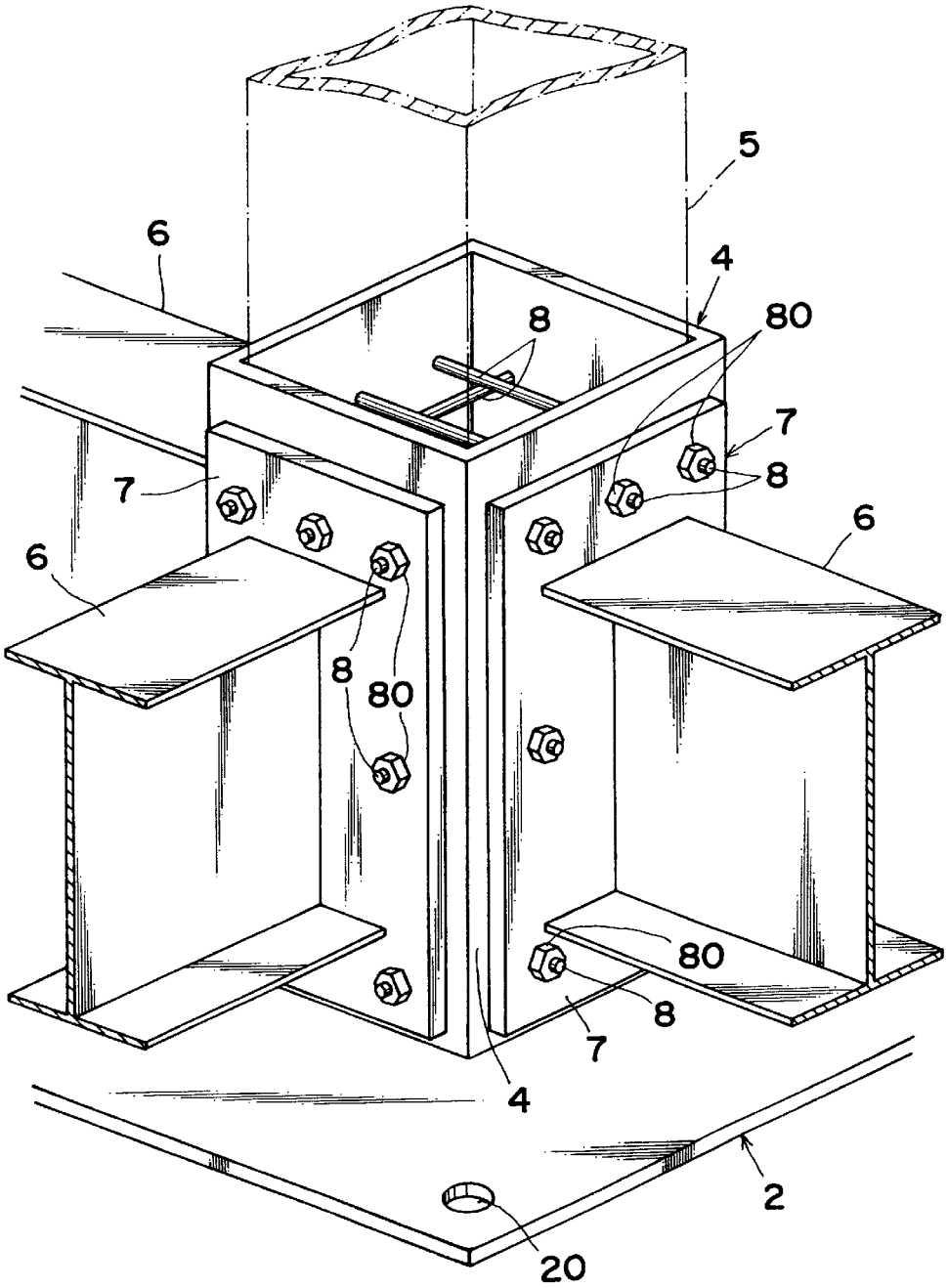
FIG. 9 is a view for explaining the state of the beam of FIG. 8 connected to the square sleeve and the square column pipe.

Then, the beam 6 is joined to the square column pipe 5 as shown in FIG. 9 by the steps of bringing the end plate 7 preliminarily welded to the end of the beam into contact with the predetermined wall surface of the square sleeve 4 in a state that the lower end of the square column pipe 5 is preliminarily inserted into the square sleeve 4 on the base plate 2 placed to the upper surface of the footing 1 as described above, and then fastening the end plate to the square sleeve with the connecting bolts 8.

At this time, the bolt holes 40 provided in the wall surfaces of the square sleeve 4 are different in height between the bolt holes 40 provided in the front and rear wall surfaces and the bolt holes 40 provided in the left and right wall surfaces. Thus, in order to cope with the difference in height described above, there is the need for the formation of two kinds of beams, that is, longitudinal beams 6, to which the end plates 7 are connected by setting the positions of the bolt holes 70 so as to bring the end plates 7 connected to the beams 6 into contact with the front and rear wall surfaces of the square sleeve 4, and lateral beam 6, to which the end plates 7 are connected by setting the positions of the bolt holes 70 so as to bring the end plates into contact with the left and right wall surfaces of the square sleeve 4. These two kinds of beams 6 are adapted to bring the end plates into contact with the predetermined wall surfaces of the square sleeve 4 in proper correspondence thereto.

The contact of the beams to the square sleeve requires the process of removing the nuts 80 from the connecting bolts 8 inserted in the temporary tightening state to slightly shift the connecting bolts toward the wall surface opposite to the wall surface, which is in contact with the end plate 7, of the square sleeve 4 such that the ends of the connecting bolts 8 are put in a draw-in state, then bringing the end plate 7 properly into contact with the predetermined wall surface of the square sleeve 4, and thereafter inserting the connecting bolts 8 into the bolt holes 70 through a slide motion toward the contacted end plate 7 to fasten the connecting bolts with the nuts 80.

Figure 10:
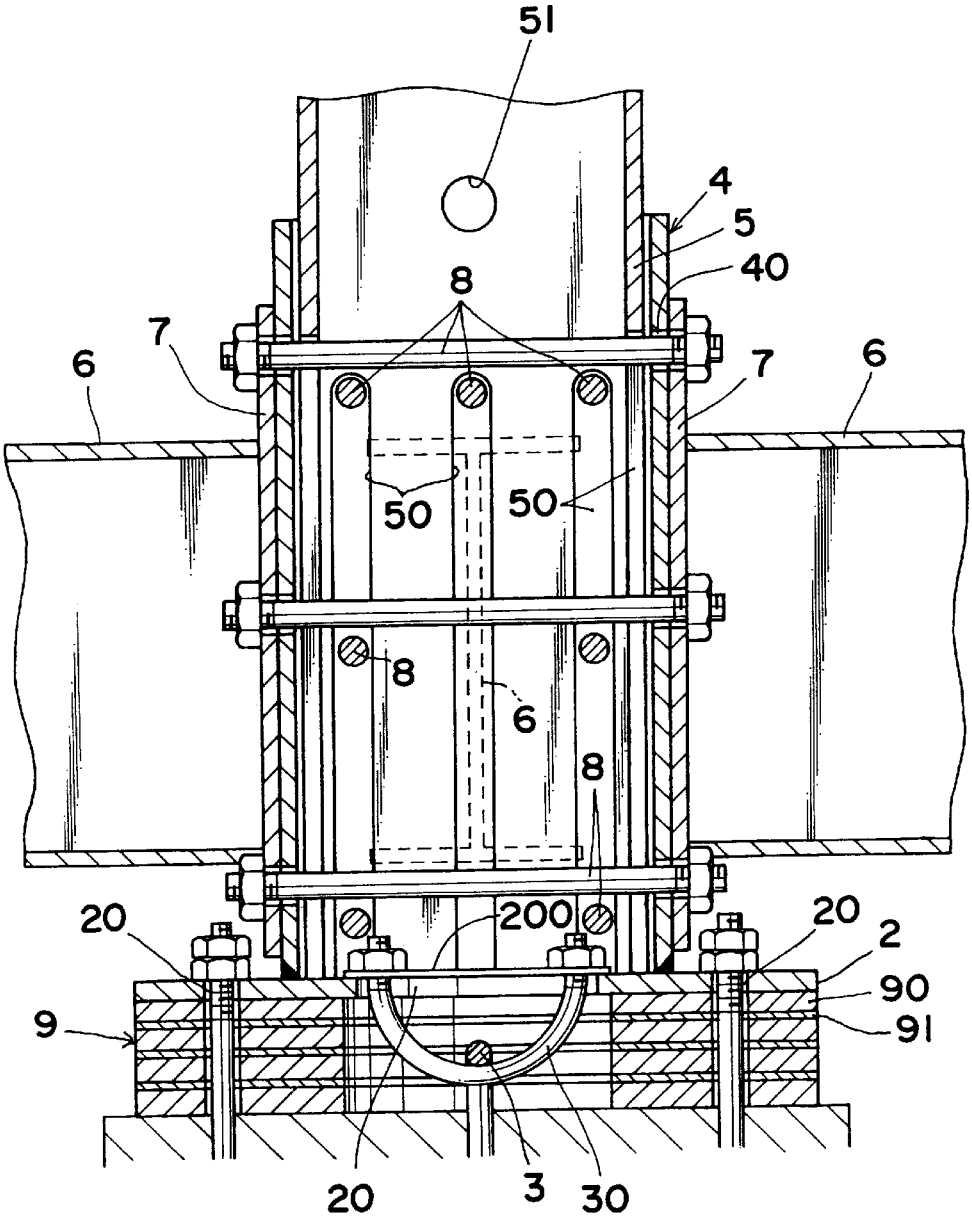
FIG. 10 is a longitudinal sectional side view showing the beam in the state of FIG. 9.
Figure 11:
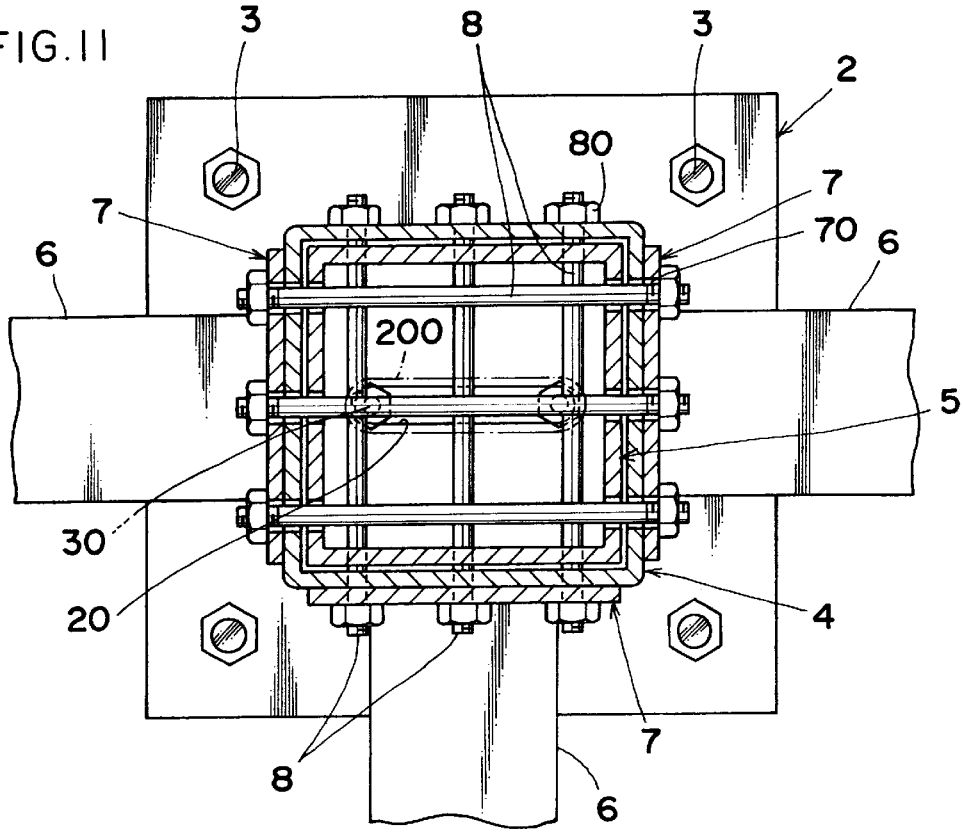
FIG. 11 is a cross-sectional plan view showing the beam in the state of FIG. 9.

Thus, after the beam 6 is tied to the square sleeve 4 by fastening the end plate 7 as shown in FIGS. 10 and 11, the injection of non-shrink mortar is performed through the mortar injection port 51 provided in the square column pipe 5 to unite the cavity of the square sleeve 4 and also the lower end cavity of the square column pipe 5 with the mortar together with the connecting bolts 8 inserted thereinto.

At this time, the opening 41 provided in the lower end of the square sleeve 4 is closed with the cover plate 42 when this opening is placed in an opened state depending on the direction of the beams 6 joined to the square sleeve 4, and the bolt hole 20 in the shape of the slot to permit the insertion of the U-shaped connecting bolt 30 in the center of the base plate 2 is also closed with a plate 200.

The fastening of the end plate 7 to the square sleeve 4 by tightening the nuts 80 of the connecting bolts 8 may be performed after the hardening of the injected mortar.

The injection of the non-shrink mortar may be performed before the end plate 7 of the beam 6 is brought into contact with the square sleeve 4 by making it condition that the connecting bolts 8 are temporarily tightened when the lower end of the square column pipe 5 is inserted into the square sleeve 4, and the fastening of the end plate may be performed in the manner of removing the nuts 80 from the connecting bolts 8 after the hardening of the mortar, and then fitting the connecting bolts to the bolt holes 70 of the end plate 7 of the beam 6 to tighten the connecting bolts 8 with the nuts 80.

In the above case, since the connecting bolts 8 are fixed to the square sleeve 4, the troublesome work is required for bringing the end plate 7 of the beam 6 into contact with the predetermined wall surface of the square sleeve 4.

A description will now be given of an embodiment of a construction method of joining the beam to the column with the connecting bolts in the column middle part with reference to FIG. 12.

In the case where there is less load on the upper floor to permit the reduction in size of the members, the following two kinds of methods are conceivable as the construction method of joining the beam to the column in the middle part of the column, that is, one of fitting the lower end of a smaller-sized square column pipe for the upper floor into the upper end cavity of the square column pipe for the lower floor to join these square column pipes together in a lapped state, and the other of connecting the lower end of a smaller-sized square column pipe for the upper floor to a joint piece mounted to the upper end of the square column pipe for the lower floor to join these square column pipes together.

Figure 12:
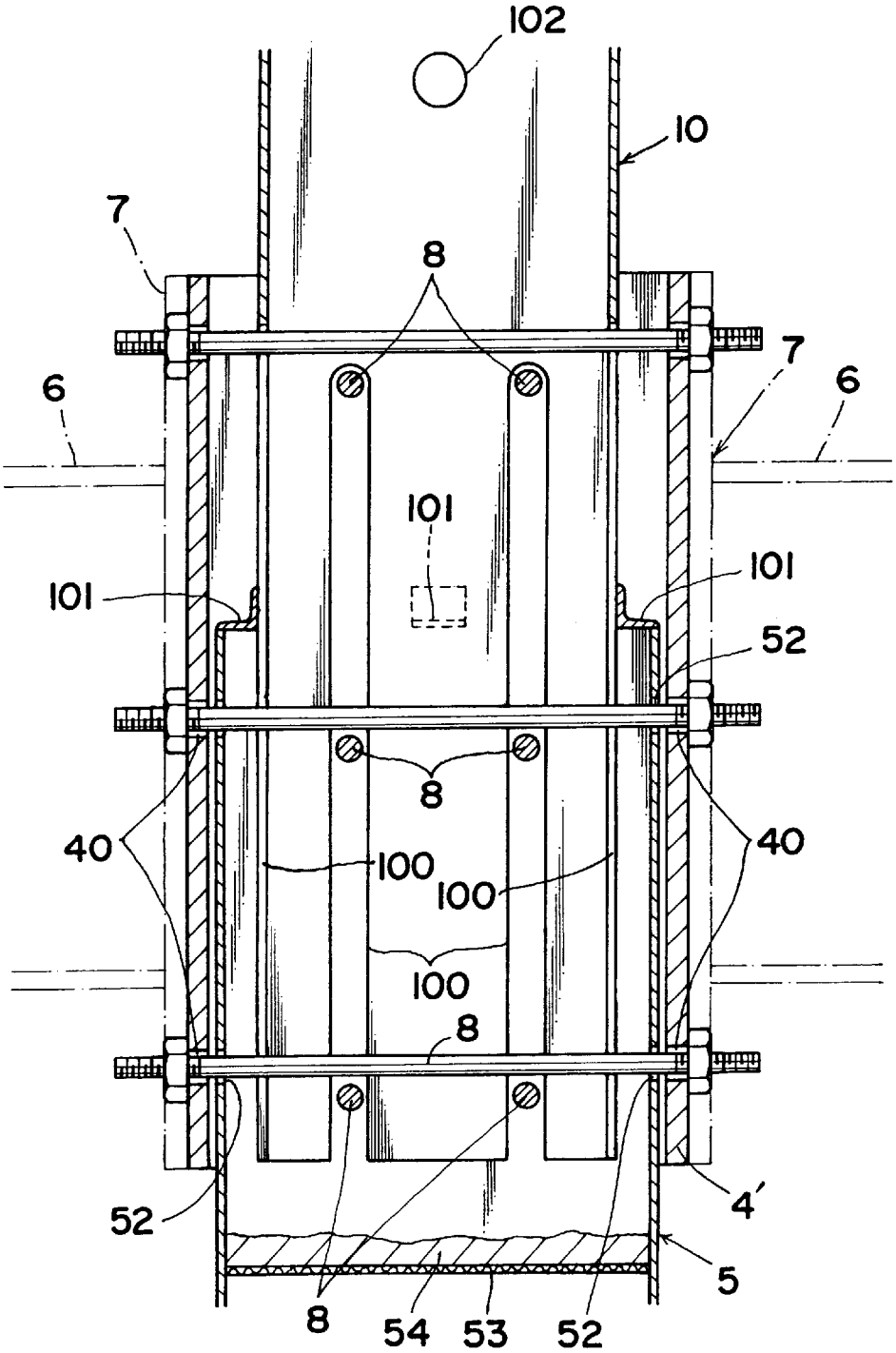
FIG. 12 is a longitudinal sectional view showing a column middle part in the embodiment of FIG. 1.

FIG. 12 shows the first embodiment of the construction method in the column middle part.

In FIG. 12, reference numeral 5 denotes the upper end of the square column pipe 5 used for the lower floor and set upright in the manner of inserting the lower end of this square column pipe into the square sleeve 4 on the upper surface of the base plate to tie the square column pipe and the square sleeve with the connecting bolts 8 and then integrally connecting the square column pipe to the square sleeve 4 by the injection of mortar according to the embodiment of the column base part described above, 4' is a square sleeve formed in the similar manner to the square sleeve 4 described above and used independently without being welded to the base plate 2, 10 is a square column pipe used for the upper floor, formed to be smaller in size than the square column pipe 5 for the lower floor and connected at its lower end to the upper end of the square column pipe 5 for the lower floor in the lapped state, 8 is a connecting bolt, and 6 and 7 shown by chain lines are respectively a beam and an end plate integrally connected to the longitudinal end of the beam by welding.

The square sleeve 4' used for the column middle part is similar in structure to the square sleeve 4 used for the column base part, except that the lower end surface is formed in the flat shape, instead of the taper surface 4*a* for connecting the lower edge to the base plate 2 by welding, since the square sleeve 4' is used independently without being welded to the base plate 2.

The square sleeve 4' is preliminarily placed in the temporary tightening state to the upper end circumference of the square sleeve 4 by making it condition that the square sleeve 4' is fitted around the upper end circumference of the square column pipe 5 for the lower floor such as to lap the lower half of the square sleeve with the upper end circumference of the square column pipe 5 for the lower floor, and that the connecting bolts 8 are preliminarily inserted in the temporary tightening state into the bolt holes 40 provided in the square sleeve and also the bolt holes 52 provided in the upper end of the square column pipe 5.

The square column pipe 10 for the upper floor has notches 100 in the shape of vertical slits in the peripheral wall on the lower end side at portions corresponding to the connecting bolts 8 preliminarily inserted in the temporary tightening state into the square sleeve 4, and joint pieces 101 are integrally welded to the outer surface of the square column pipe 10, and make contact with the upper edge of the square column pipe 5 for the lower floor to restrain the insertion depth of the square column pipe 10 for the upper floor when this insertion depth reaches a predetermined depth as the result of inserting the lower end of the square column pipe 10 for the upper floor into the inside of the upper end of the square column pipe 5 for the lower floor.

Then, the square sleeve 4', the square column pipe 5 for the lower floor, the square column pipe 10 for the upper floor and the connecting bolts 8 inserted in the temporary tightening state into the square sleeve and the square column pipes for the upper and lower floors are allowed to be integrally connected together by injecting non-shrink mortar through a mortar injection port 102 provided in the square column pipe 10 for the upper floor in a state that the square column pipe 10 is preliminarily inserted. In this case, the square column pipe 5 for the lower floor is preliminarily provided with a urethane foam receiver 53 made of a net such as a wire net in the shape of a shelf on the upper end side at a position serving as the bottom of a portion lapped with the square column pipe 10 for the upper floor so as to inject the mortar into the upper surface of instantaneous foaming urethane foam 54 placed in a solidified state after being supplied up to a predetermined thickness to the upper surface of the urethane foam receiver 53 prior to the injection of mortar.

After the hardening of the mortar, the removal of the nuts 80 from the connecting bolts 8 is performed to fit the bolt holes 70 of the end plate 7 of the beam 6 around the connecting bolts 8 which are then fastened with the nuts 80, resulting in a completion of the connection of the beam.

In the construction method of joining, the injection of non-shrink mortar may be also performed after the process of bringing the end plate 7 of the beam 6 into contact with the square sleeve to fasten the end plate to the square sleeve with the connecting bolts 8.

Figure 13:
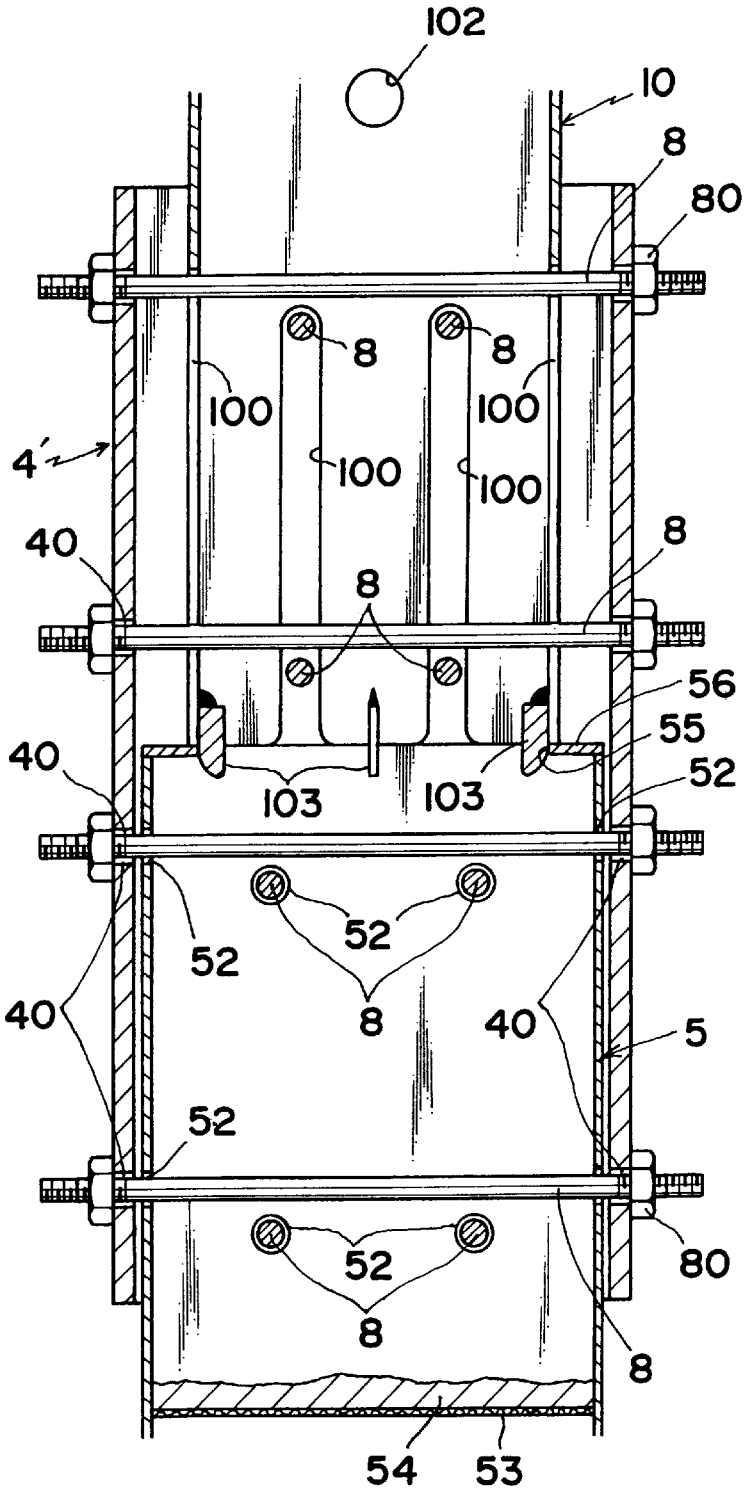
FIG. 13 is a longitudinal sectional view showing another embodiment of the column middle part.

A description will now be given of the second embodiment with reference to FIG. 13.

This embodiment is adapted to join the upper end side of the square column pipe 5 for the lower floor to the lower end side of the square column pipe 10 for the upper floor without the need for lapping.

Figure 14:
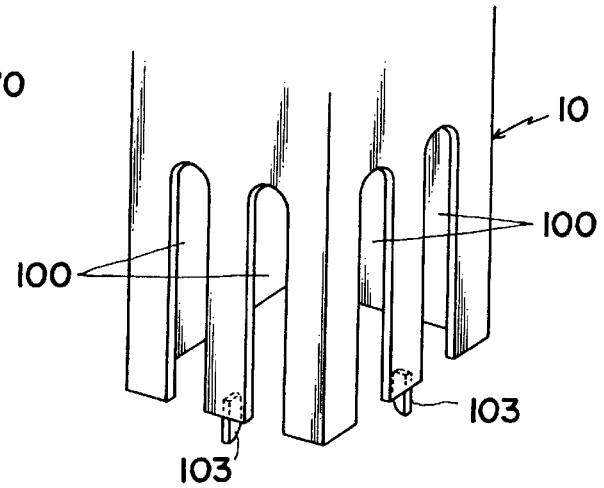
FIG. 14 is a perspective view showing a joint portion between a square column pipe for a lower floor and a square column pipe for an upper floor in the course of joining in the embodiment.
Figure 14:
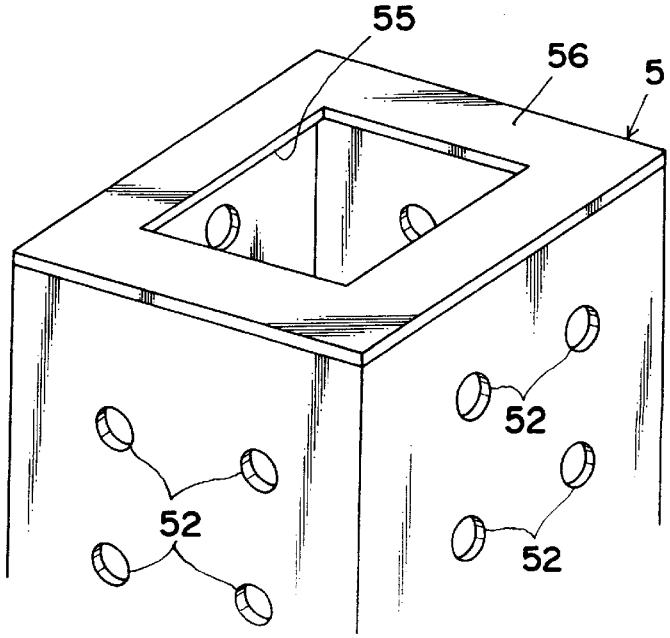

That is, as shown in FIG. 14, the square column pipe 10 for the lower floor is mounted with a guide piece 56 at its upper end surface, and the guide piece has a center guide hole 55 in the shape of a square hole of a size corresponding to the inner diameter of the square column pipe 10 for the upper floor, while the square column pipe 10 for the upper floor is provided with downward-projecting guide pins 103 for location at its lower end and these guide pins are adapted to be fitted into the guide hole 55 of the guide piece 56 at a time when the lower end of the square column pipe for the upper floor is joined to the upper end of the square column pipe 5 for the lower floor in proper alignment with each other. Then, the fitting of the guide pins 103 of the square column pipe 10 for the upper floor into the guide hole 55 of the guide piece 56 of the square column pipe 10 for the lower floor makes it possible to perform predetermined location for end-to-end joining of the square column pipe 10 for the upper floor to the square column pipe 5 for the lower floor without the need for lapping.

The second embodiment is similar to the first embodiment described above in that after inserting the connecting bolts 8 in the temporary tightening state into the bolt holes 40 provided in the square sleeve 4', and also after providing the notches 100 in the shape of the vertical slits on the lower end side of the square column pipe 10 for the upper floor to be located at portions corresponding to the connecting bolts 8 in a part lapped with the upper half-side cavity of the square sleeve 4', the square column pipe 10 for the upper floor is joined to the square column pipe 5 for the lower floor after insertion of the square column pipe 10 into the square sleeve 4' so as to fit the notches 100 in the shape of the slits to the connecting bolts 8 preliminarily inserted in the temporary tightening state.

The second embodiment is also similar to the first embodiment in that the mortar injection port 102 is provided in the square column pipe 10 for the upper floor to inject the non-shrink mortar for fixing the lower end side of the square column pipe 10 for the upper floor to the upper end side of the square column pipe 5 for the lower floor in an end-to-end joined state when these pipes are end-to-end joined together and that the urethane foam receiver 53 such as a wire net is preliminarily provided in the shape of a shelf in the upper end-side cavity of the square column pipe 5 for the lower floor, and the instantaneous foaming urethane foam 54 is supplied to the urethane foam receiver and is then put in a solidified state prior to the injection of mortar in order to allow the joint portion to be filled with the mortar in a restricted state.

Similarly to the first embodiment, the column and the beam in the column middle part joined as described above are joined by the steps of removing the nuts 80 from the connecting bolts 8 after the hardening of the charged non-shrink mortar, then bringing the end plate 7 of the beam 6 into contact with the square sleeve to fit the bolt holes 70 of the end plate around the connecting bolts, and then tightening the connecting bolts with the nuts 80 as shown by a chain line in FIG. 12. Further, similarly to the first embodiment, the injection of the non-shrink mortar may be also performed after placing the end plate 7 of the beam 6 to the square sleeve by bringing the end plate into contact with the square sleeve, and the tightening with the nuts 80 may be also performed again after the hardening of the mortar.

Figure 16:
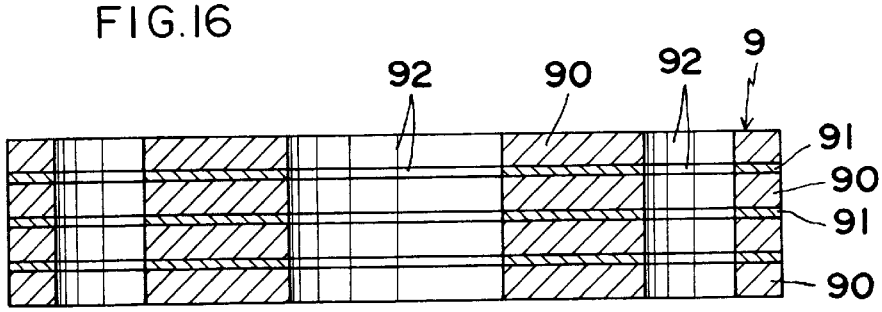
FIG. 16 is a longitudinal sectional view showing the base isolation pad of FIG. 15.
Figure 15:
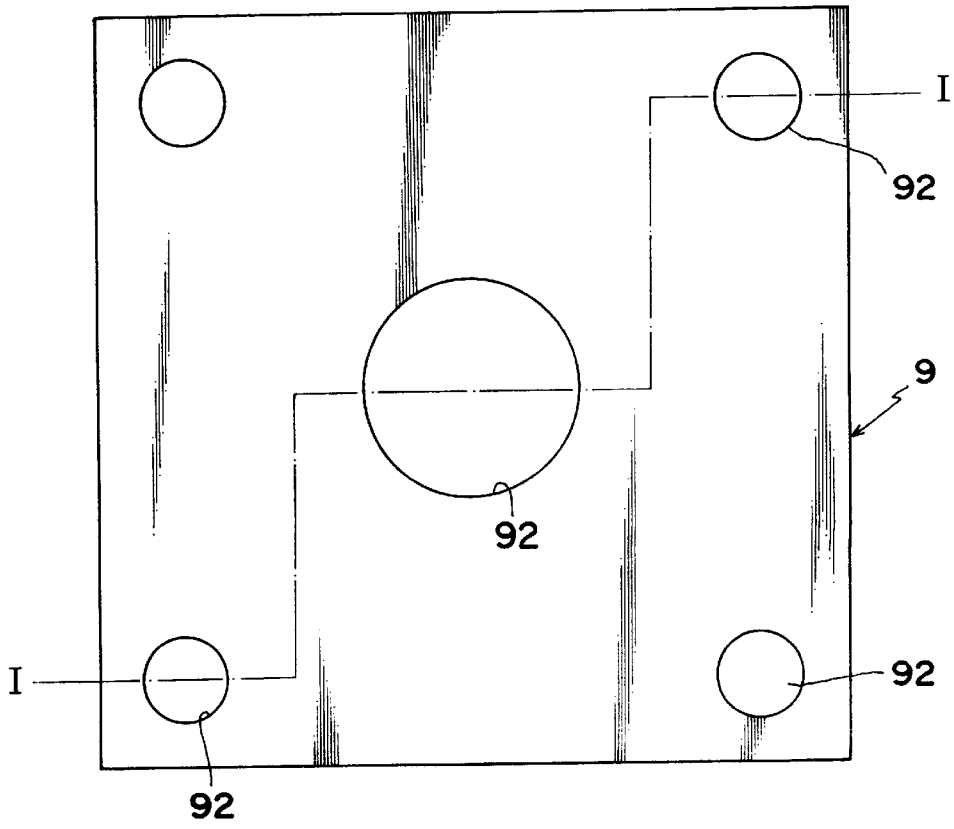
FIG. 15 is a plan view showing a base isolation pad.

FIG. 15 is a plan view showing a base isolation pad 9 interposed between the base plate 2 and the footing 1, and FIG. 16 is a longitudinal sectional view taken along line I—I in FIG. 15.

In FIGS. 15 and 16, reference numeral 90 denotes each pad formed in the shape of a square base plate by an elastic material of rubber system having a vibration-velocity damping property, and 91 is each metallic plate formed by a metallic material such as stainless steel and aluminum in the shape of a thin plate in conformity to the pad 90 and integrally deposited to the lower surface of the pad 90 in layers. The pad 90 and the metallic plate 91 have respectively bolt holes 92 in the peripheral edges to permit the insertion of the anchor bolts 3 and also bolt holes 93 in the center to permit an inverted U-shaped connecting bolt 30 for anchoring the anchor bolt 3 planted in the footing 1.

Figure 17:
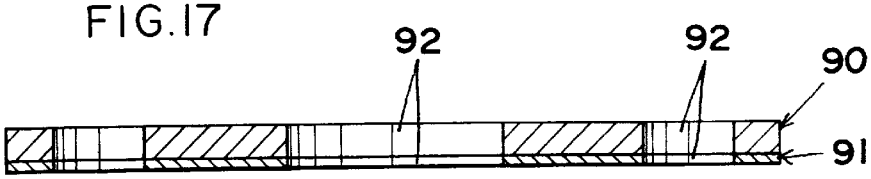
FIG. 17 is a longitudinal sectional view showing a unit of the base isolation pad of FIG. 15.
Figure 18:
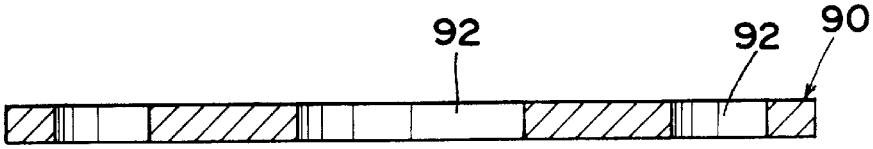
FIG. 18 is a longitudinal sectional view showing a pad incorporated into the lowermost lower of the base isolation pad of FIG. 15.

As shown in FIG. 17, the base isolation pad 9 is formed by placing a large number of pads 90 and a large number of metallic plates 92 in layers such that the upper surface of each pad 90 makes a slide motion relative to the lower surface of the metallic plate 91 by making it condition that a set of one pad 90 and one metallic plate 91 integrally deposited to the lower surface of the pad is used as a unit. However, as shown in FIG. 18, the pad 90 placed in the lowermost layer does not need for deposition to the metallic plate 91, and as a result, the lower surface of the base plate 2 and the upper surface of the footing 1 are sure to make contact with the pads 90.

As has been described in the foregoing, the means of joining the column and the beam in the building structure based on the heavy-weight steel frame construction according to the present invention comprises the steps of inserting the lower end of the square column pipe 5 formed by the steel material into the square sleeve 4 set up on the upper surface of the footing 1 through the base plate 2 to connect the lower end of the square column pipe to the square sleeve 4 with the connecting bolts 8 in the temporary tightening state by making it condition that the square sleeve 4 formed by the steel material is preliminarily welded as one body to the upper surface of the base plate 2 placed to the footing 1 with the anchor bolts 3 and that the end plate 7 formed by the steel material adapted to be joined to the outer wall surface of the square sleeve 4 is preliminarily mounted as one body by welding to the longitudinal end of the beam formed by the shape steel, bringing the end plate 7 preliminarily welded to the end of the beam 6 into contact with the outer surface of the square sleeve 4 and fastening the end plate to the square sleeve 4 with the connecting bolts 8 to thereby join the beam 6 to the square column pipe 5 serving as the column. Thus, since the column may be manufactured in the factory without the need for the auxiliary joint member which has been heretofore surely mounted to the column before the delivery, it is possible to easily perform the loading of columns for transportation in an orderly manner. Besides, the beam may be joined to the column by means of connection with the connecting bolts, and a straight material with no joint portion is available for the beam.

What is claimed is:

1. A construction method of joining a column and a beam in a building structure based on heavy-weight steel frame construction, comprising the steps of:

setting upright a square sleeve formed by a steel material in the shape of a box and/or square cylinder on the center of the upper surface of a base plate formed by a steel material in the shape of a plate in a posture of extending an axis in a vertical direction to connect the square sleeve to the base plate by welding;

placing the base plate to the upper surface of a constructed footing through anchor bolts;

inserting the lower end of a square column pipe formed by a steel material in the shape of a square pipe into the square sleeve on the upper surface side of the base plate;

then tying the square column pipe in a temporary tightening state to the square sleeve with connecting bolts inserted into bolt holes provided in the square column pipe and bolt holes provided at predetermined positions of the wall surface of the square sleeve;

bringing an end plate formed by a steel material into contact with the wall surface of the square sleeve by making it condition that said end plate is preliminarily welded to the longitudinal end of the beam; and joining the beam to the column by fastening the end plate to the square sleeve with said connecting bolts.

2. A construction method of joining a column and a beam in a building structure based on heavy-weight steel frame construction according to claim 1, wherein the bolt holes provided on the lower end side of the square column pipe to permit the insertion of the connecting bolts are formed in the shape of vertically slit-like notches incised from the lower edge of the square column pipe.

3. A construction method of joining a column and a beam in a building structure based on heavy-weight steel frame construction according to claim 1, wherein the square sleeve welded to the upper surface of the base plate placed to the footing and the square column pipe inserted into the cavity of the square sleeve are united in one body with non-shrink mortar injected into the cavity of the square sleeve and that of the square column pipe in a state that the connecting bolts are inserted in the temporary tightening state into the square sleeve and the square column pipe.

4. A construction method of joining a column and a beam in a building structure based on heavy-weight steel frame construction, comprising the steps of:

fitting a square sleeve formed by a steel material around the circumference of a joint portion between the upper end of a square column pipe formed by a steel material for a lower floor and the lower end of a square column pipe formed by a steel material for an upper floor to connect the joint portion between the square column pipe for the lower floor and the square column pipe for the upper floor in the temporary tightening state with connecting bolts inserted into said square column pipes and said square sleeve;

in this state, uniting the square column pipe for the lower floor and the square column pipe for the upper floor together with non-shrink mortar injected into the cavity of the joint portion;

bringing the end plate preliminarily connected as one body by welding to the longitudinal end of a beam formed by shape steel into contact with the outer wall surface of the square sleeve; and fastening the end plate to the square sleeve with said connecting bolts to join the beam to the column in the column middle part.

* * * * *